US005886668A

United States Patent [19]

Pedersen et al.

[11] Patent Number: 5,886,668

[45] Date of Patent: Mar. 23, 1999

[54] HAND-HELD TRANSMITTING AND/OR RECEIVING APPARATUS

[75] Inventors: Gert Frølund Pedersen, Storvorde; Jan Gert Thomsen, Aalborg, both of Denmark

[73] Assignee: Hagenuk Telecom GmbH, Kiel, Germany

[21] Appl. No.: 916,740

[22] Filed: Aug. 19, 1997

Related U.S. Application Data

[63] Continuation of Ser. No. 545,826, filed as PCT/EP95/00812, Mar. 6, 1995, abandoned.

[30] Foreign Application Priority Data

Mar. 8, 1994 [DK] Denmark ..... 0267/94

[51] Int. Cl.[6] ..... H01Q 1/24

[52] U.S. Cl. ..... 343/702; 343/700 MS; 343/846

[58] Field of Search ..... 343/700 MS, 841, 343/702, 829, 846, 848; H01Q 1/24

[56] References Cited

U.S. PATENT DOCUMENTS

| | | | |
|---|---|---|---|
| 4,191,959 | 3/1980 | Kerr | 343/761 X |
| 4,641,366 | 2/1987 | Yokayama et al. | 343/702 X |
| 4,701,763 | 10/1987 | Yamamoto, et al. | 343/700 |
| 4,876,709 | 10/1989 | Rogers et al. | 379/61 |
| 4,980,694 | 12/1990 | Hines | 343/702 |
| 5,365,246 | 11/1994 | Rasinger et al. | 343/830 |

FOREIGN PATENT DOCUMENTS

| | | |
|---|---|---|
| 0176311 | 4/1986 | European Pat. Off. . |
| 0522538 | 1/1993 | European Pat. Off. . |

*Primary Examiner*—Don Wong
*Assistant Examiner*—Tho Phan
*Attorney, Agent, or Firm*—Wood, Herron & Evans, L.L.P.

[57] ABSTRACT

Hand-held transmitting and/or receiving apparatus, including a housing made of electrically non-conductive material, an electric circuit positioned within the housing, an electrical ground plane positioned within the housing, an antenna resonator element extending approximately parallel to the ground plane and having a first free end and a second end electrically connected by a ground connector to the ground plane and an arrangement for connecting the ground plane and the resonator element to the electric circuit. The resonator element, the ground plane and the ground connector are positioned about and fixed to a dielectric body positioned inside the housing. This antenna is easily manufactured and reduces the influence of mechanical tolerances and mechanical and thermal influences on the electrical parameters of the antenna.

13 Claims, 1 Drawing Sheet

HAND-HELD TRANSMITTING AND/OR RECEIVING APPARATUS

RELATED APPLICATION

This application is a continuation of application Ser. No. 08/545,826 filed on Nov. 8, 1995, now abandoned, entitled HAND-HELD TRANSMITTING AND/OR RECEIVING APPARATUS which is a continuation of PCT application PCT/EP95/00812, filed on 6 Mar. 1995.

BACKGROUND OF THE INVENTION

1. Field of the Invention

The invention relates to a hand-held transmitting and/or receiving apparatus including a housing made of an electrically non-conductive material, an electric circuit inside the housing, an electrical ground plane inside the housing made from non-conductive material, an antenna resonator element extending approximately parallel to the ground plane and having a first free end and a second end electrically connected by a ground connector to the ground plane and a device for connecting the ground plane and the resonant element to the electric circuit.

2. Description of the Prior Art

Hand held transmitting and receiving devices are well known. Such a device is disclosed in European Patent No. EP 0 484 454 B1 where an antenna resonant element has the form of an angled metal sheet of metal foil applied on the outside of a plastic housing. An electrical ground plane has the form of a shielding housing positioned inside the plastic housing which shielding housing contains the electric circuit. Between the shielding housing and the plastic housing and in the area of the antenna resonant element is an air gap. A grounding lead extends through a slit in the plastic housing and connects the angled leg of the L-shaped antenna resonant element to the shielding housing.

This apparatus has the disadvantage that it is difficult to form the slit in the plastic housing for the lead to extend through. Either the slit must be formed when forming the housing or the slit has to be cut after the housing is formed. Furthermore, it is difficult to provide the ground connector leading through the slit and to connect it to the antenna resonant element at one end and to the shielding housing inside the plastic housing at the other end.

An important electrical disadvantage of this known apparatus results from the air gap between the shielding housing and the plastic housing on which an antenna resonant element is fixed. The electrical parameters of the resonant element are influenced by this air gap. Since tolerances of the dimensions of this air gap and changes due to mechanical and thermal influences are unavoidable it is not possible to keep the electrical parameters of the antenna constant. This results in mismatching, standing waves on the feed line to the antenna and changes of the radiation pattern.

SUMMARY OF THE PRESENT INVENTION

The object of the invention is to overcome the disadvantages of this state of the art namely to simplify the manufacture of the antenna, and reduce the influence of mechanical tolerances and mechanical and thermal influences on the electrical parameters of the antenna.

The basic idea of the invention is to fix all parts of the antenna, namely the resonant element, the ground plane and the ground connector, to a separate dielectric body. This eliminates the air gap between the conductive elements of the antenna and the dielectric body so that electric parameters of the antenna are only influenced by the thickness of the dielectric body and the dielectric values of the material of this body. It is easy to assure low tolerances of the thickness of the body during manufacturing. Also variations occuring over time are reduced.

According to one embodiment of the invention the resonant element, the ground plane and the ground connector form an electrically conducting layer or coating for the dielectric body. This antenna unit is easy to manufacture and it can be tuned prior to assembling and introduction of the antenna into the housing.

The dielectric body with the ground plane may extend over approximately the entire internal width of the housing while the ground plane is connected to a ground of the electric circuit and covers at least a part of the electric circuit. Thus, the ground plane serves as a shield for the electric circuit.

The resonant element may have approximately the same width as the ground plane providing a good broad band characteristics for the antenna. The same advantage results from a further improvement according to which a ground connector extends over the entire width of the resonant element.

According to a further implementation of the invention an elongated feeder element is provided at one side of the resonant element for coupling the feeder element to the resonant element, one end of the feeder element representing a feeding end being coupled to the device connecting the resonant element to the electric circuit. This improvement avoids a galvanic contact between the electric circuit and the resonant element. Preferably the feeder element extends over approximately the entire length of the resonant element. By this arrangement an electromagnetic coupling is achieved. Additionally, the feeding end of the feeder element can be positioned at the free end of the resonant element.

According to a further aspect of the invention, the conductive elements of the antenna unit are in the form of an electrically conductive layer or coating on the dielectric body and a projection is provided extending from an edge of the free end of the resonant element. The projection has a smaller width than the resonant element. By adjusting the length of the projection the resonant frequency of the resonant element can be tuned. Preferably the width of the projection is at most about one tenth the width of the resonant element. This dimensioning of the projection makes fine tuning of the resonant element possible.

According to a still further implementation of the invention the ground plane and/or the resonant element and/or the feeding element are connected to the electric circuit by elastic, electrically conducting material positioned under pressure between opposite contact points or contact lines. This has the advantage that the connections between the antenna unit and the electric circuit are made automatically during assembling when the antenna unit is inserted into the housing.

According to a yet further aspect of the invention the dielectric body has a recess, the surface of which is covered with the conductive layer of the ground plane. The recess is surrounded by protrusions or ribs covered with the conductive layer of the ground plane for connecting the ground plane to ground of the electric circuit. This provides screened cavity for elements of the electric circuit.

Instead of one single antenna resonant element at least two resonant elements may be located over the ground plane.

BRIEF DESCRIPTION OF THE DRAWINGS

In the following the invention will be described in more detail by way of examples shown in the drawings in which.

DETAILED DESCRIPTION OF THE PRESENTLY PREFERRED EMBODIMENTS

Figure 1:
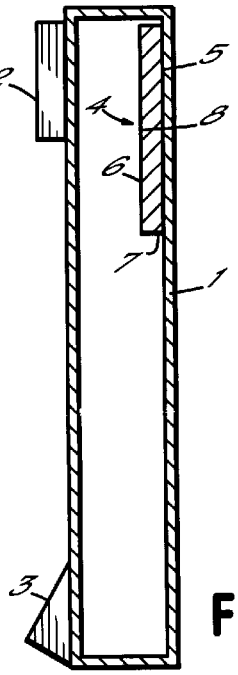
FIG. 1 is a partial cross sectional view of an embodiment of the present invention in which the electric circuit is omitted.

FIG. 1 is a side partial cross sectional view of a hand-held transceiver including a housing 1 made from electrically non-conductive material, an earphone 2, a microphone 3 and an antenna unit 4 consisting of a resonant element 5, a ground plane 6 and a ground connector 7 connecting one end of the resonant element 5 to the ground plane 6. An electrical circuit is positioned inside the housing 1 but is not shown in FIG. 1.

The antenna element 5, the ground plane 6 and the ground connector 7 are conducting layers positioned around a separate dielectric body 8 altogether forming the independent antenna unit 4 which is fixed to the inner wall of the housing 1. The antenna unit 4 may be clamped beween the housing 1 and the electric circuit for providing mechanical holding and/or electrical connections. Since all electric elements of the antenna are positioned inside the housing 1 it is easier to connect the electric elements of the antenna to the electric circuit inside the housing 1.

Figure 2:
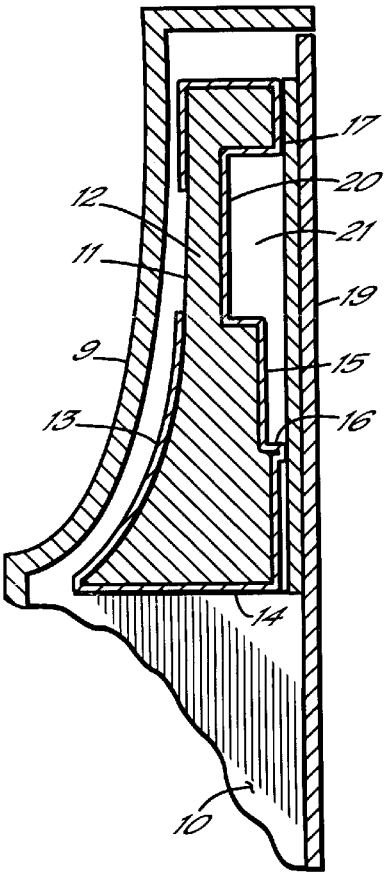
FIG. 2 is a partial cross sectional magnified view of a modified embodiment of the upper part of FIG. 1.

FIG. 2 shows a side partial cross sectional view through the upper part of another example of a hand-held apparatus with an antenna arrangement similar to that of FIG. 1. Inside a wall 9 of a housing 10, most of which is broken away an antenna unit 11 is positioned consisting of a dielectric body 12 on which an antenna resonant element 13, a ground connector 14 and a ground plane 15 are fixed in the form of electrically conductive layers. The ground plane 15 has protrusions 16 and 17 contacting a conductive elastic layer 18 on a circuit board 19 carrying the electrical leads and elements (not shown) in a known manner.

The dielectric body 12 has a recess 20 defining cavity 21 into which circuit elements on the circuit board 19 may extend and which are well-screened by the electrically conductive layer of the ground plane 15.

Figure 3:
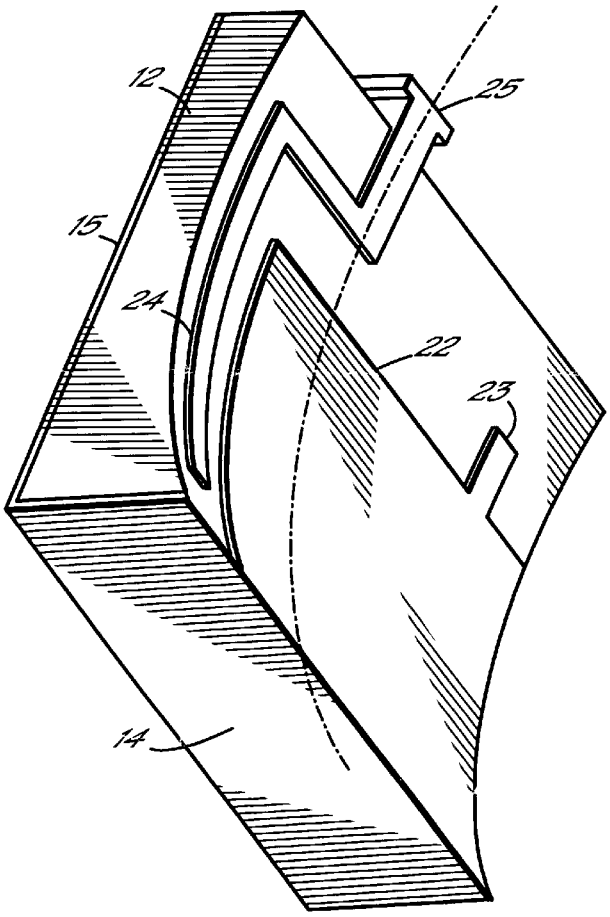
FIG. 3 is a bottom perspective view of the antenna unit of FIG. 2.

FIG. 3 shows a bottom perspective view of the antenna unit 11 comprising the dielectric body 12, the resonant element 13, the ground connector 14 and the ground plane 15. It can be seen that from an edge 22 of the free end of the resonant element 13 a projection 23 extends, the width of the projection being much smaller than the width of the resonant element 13. The projection 23 can be shortened for tuning purposes.

In FIG. 3 it can be seen that at one side of the resonant element 13 a feeder element 24 is fixed on the surface of the dielectric body 12, the feeder element 24 extending approximately along the entire length of the resonant element 13. The free end of the feeder element 24 is positioned near the ground connector 14 while another elastic end 25 of the feeder element 24 extends along the side of the dielectric body 12 on which the ground plane 15 is located. Therefore, the feeder element 24 can be connected to the electric leads of the circuit board 19 by a small conductive and elastic part or element 25 in the same manner as the ground plane 15 is connected to the circuit board 19 by the layer 18.

We claim:

1. A hand-held radio transceiver comprising:

a housing, an electric circuit comprising a substrate positioned within the housing and supporting electric circuit components thereon, a conductive covering separate from said housing, having first and second sides, a first side positioned over said substrate and enclosing said electric circuit components, an antenna system extending along the housing adjacent to said electric circuit, comprising a ground plane, wherein said conductive covering forms said ground plane, said antenna system further comprising a resonant element extending generally parallel to the ground plane, the resonant element having a free end, said resonant element extending on said second side of said conductive covering forming said ground plane and opposite to said electric circuit, and a ground connector extending between and electrically connecting the ground plane to the resonant element at a grounded location distal from said free end.

2. The hand-held radio transceiver of claim 1 wherein said ground plane defines a recess extending away from said electric circuit, said electric circuit being positioned within said recess.

3. The hand-held radio transceiver of claim 2 wherein said ground plane defines protrusions about said recess electrically contacting said electric circuit.

4. The hand-held radio transceiver of claim 1, wherein said antenna system further comprises a dielectric body, and said ground plane, resonant element and ground connector of said antenna system comprise electrically conductive layers on said dielectric body.

5. The hand-held radio transceiver of claim 1, wherein said housing is electrically non-conductive, and said antenna system is positioned inside of said housing.

6. The hand-held radio transceiver of claim 1, wherein said housing rear side has a width and said ground plane has a width substantially equal to the width of said housing rear side.

7. The hand-held radio transceiver of claim 1, wherein said ground plane has a width and said resonant element has a width substantially equal to the width of said ground plane.

8. The hand-held radio transceiver of claim 1, wherein said resonant element has a width and said ground connector has a width substantially equal to at least one-half the width of said resonant element.

9. The hand-held radio transceiver of claim 1, further comprising an elastic, electrically conductive element positioned between said electric circuit and said ground plane and forming an electrical connection therebetween.

10. The hand-held radio transceiver of claim 1, wherein said antenna system further comprises a feeder element electrically connecting the resonant element to the electric circuit without mechanically contacting the resonant element.

11. The hand-held radio transceiver of claim 10, further comprising an elastic, electrically conductive element positioned between said electric circuit and said feeder element and forming an electrical connection therebetween.

12. The hand-held radio transceiver of claim 1, wherein said resonant element of said antenna system further comprises a tuning stub projecting from said free end, said tuning stub having a width smaller than a width of said free end.

13. The hand-held radio transceiver of claim 1, wherein said resonant element has an arcuate surface contour between said grounded location and said free end.

* * * * *

UNITED STATES PATENT AND TRADEMARK OFFICE

CERTIFICATE OF CORRECTION

PATENT NO. : 5,886,668

DATED : March 23, 1999

INVENTOR(S) : Pedersen et al.

It is certified that error appears in the above-identified patent and that said Letters Patent is hereby corrected as shown below:

Column 1, line 18, delete "non-conducting", insert -a conductive-.

Column 1, line 67, delete "so that electric", insert -so that the electric-.

Column 2, line 18, delete "providing a good", insert -providing good-.

Column 3, line 33, delete "away an", insert -away, an-.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*